United States Patent [19]

Laine

[11] Patent Number: 4,902,052

[45] Date of Patent: Feb. 20, 1990

[54] LOCKING DEVICE

[75] Inventor: Yrjö T. Laine, Kauniainen, Finland

[73] Assignee: Airi Laine, Kauniainen, Finland

[21] Appl. No.: 225,894

[22] Filed: Jul. 29, 1988

[30] Foreign Application Priority Data

Jul. 31, 1987 [FI] Finland ..... 873345

[51] Int. Cl.[4] ..... E05C 1/06

[52] U.S. Cl. ..... 292/144; 292/172; 292/254

[58] Field of Search ..... 292/254, 144, 341.16, 292/172; 70/277, 279, 282, 143

[56] References Cited

U.S. PATENT DOCUMENTS

| | | | |
|---|---|---|---|
| 1,089,324 | 3/1914 | Chesley | 292/254 |
| 1,968,285 | 7/1934 | Egan | 292/172 |
| 2,366,847 | 1/1945 | Fendring | 292/254 |
| 3,614,147 | 10/1971 | Spector | 292/254 |
| 3,872,696 | 3/1975 | Geringer | 292/254 X |
| 3,998,483 | 12/1976 | Yan | 292/254 |
| 4,132,439 | 1/1979 | Millar | 292/144 |
| 4,271,691 | 6/1981 | Logan | 292/254 X |

FOREIGN PATENT DOCUMENTS

| | | | |
|---|---|---|---|
| 111176 | 8/1940 | Australia | 292/254 |
| 266253 | 8/1912 | Fed. Rep. of Germany . | |
| 2652562 | 11/1976 | Fed. Rep. of Germany . | |
| 3013851 | 4/1980 | Fed. Rep. of Germany . | |
| 661855 | 3/1929 | France | 292/172 |
| 6398 | of 1906 | United Kingdom | 292/172 |
| 9366 | of 1908 | United Kingdom | 292/254 |
| 12983 | 5/1914 | United Kingdom | 292/254 |
| 1495545 | 12/1977 | United Kingdom | 292/254 |

*Primary Examiner*—Lloyd A. Gall

*Attorney, Agent, or Firm*—Cushman, Darby & Cushman

[57] ABSTRACT

A locking device for doors and the like, having a bolt installed in the door frame and movable into the open position by a solenoid and into the shut position by a spring. Locking devices of this kind have not found general use, since there is no room in the frame for a device as required by the regulations wherewith the lock may be opened mechanically from the inside. This problem has been solved in such a manner that the socket of the door has a counterbolt forced by a spring against the bolt proper, whereby the spring force of the spring of the counterbolt is smaller than the spring force of the spring of the bolt.

2 Claims, 1 Drawing Sheet

SW.

SW.

LOCKING DEVICE

BACKGROUND OF THE INVENTION

This invention relates to a locking device for doors and the like, having sockets in the door frame and in the door, a bolt disposed within the socket of the frame and adapted to be displaceable partially into the socket of the door for the locking of the door, and actuating means consisting of electrical and/or mechanical means for moving the bolt into the open position and of a spring for moving the bolt into the shut position.

In conventional locks, the bolt is provided in the door, and in a locking situation it will be pushed into the socket of the frame. Locks are also previously known wherein the bolt is provided in the frame. Since in that case there is very little room for mechanical actuators, the bolts are generally electrically operated. In these cases, the rear end of the bolt is encased by a solenoid connected to a power supply and e.g. to a code key.

Safety regulations require that the door can be opened from the inside also mechanically. Since installing a mechanical actuator in the frame to be in connection with a journalled bolt will present problems owing to the lack of space, the use of locking devices of this kind has not become more prevalent, even though they have some significant advantages, including the safe placement of the device within the wall and the absence of a transmission cable between the door and the frame.

SUMMARY OF THE INVENTION

The object of this invention is to provide a locking device meeting the above-mentioned safety regulations and yet being easy to install in the door frame. The locking device of the invention is characterized in that the socket of the door has a counterbolt and a spring adapted to force the counterbolt against the bolt proper within the socket of the frame and having a spring force smaller than the spring force of the spring pertaining to the bolt proper.

The counterbolt installed in the door provides means wherewith the bolt proper may be moved from the shut position into the open position. The counterbolt may easily be connected with mechanical displacement means provided on the inside of the door, such as a turning knob. In this way, a locking device is achieved the essential parts of which—such as the bolt and the actuating means therefor—are well shielded within the frame, and the mechanical opening device for the lock is installed in the door in the conventional manner.

The mechanical displacement means for the counterbolt may be realized in a simple manner so that the counterbolt has a tooth-edged groove engaged by the pinion of the turning knob for moving the counterbolt in the socket.

BRIEF DESCRIPTION OF THE DRAWING

An advantageous embodiment of the locking device of the invention will be described in detail in the following, with reference to the accompanying drawing wherein.

DETAILED DESCRIPTION

Figures 1, 2, 3:
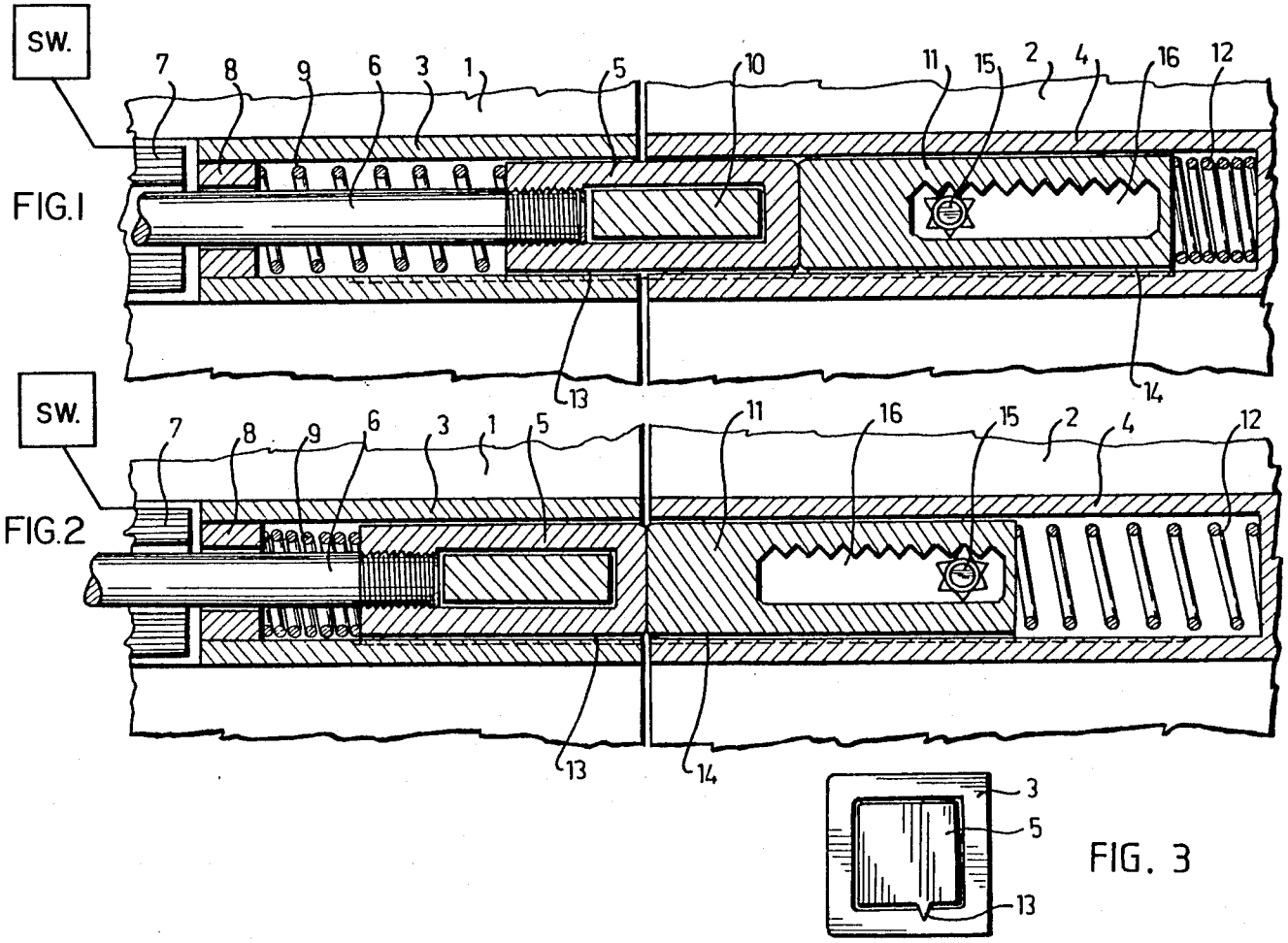
FIG. 1 is a longitudinal sectional view of a locking device of the invention in the shut position.
FIG. 2 shows the device in the open position.
FIG. 3 is a face view of that part of the locking device which faces the door frame.

FIGS. 1 and 2 show, on the left, the frame 1 and, on the right, the door 2. A socket 3 opening into the doorway is provided in the frame, and the door has a corresponding socket 4 located in line with socket 3 when the door is shut. The socket of the frame houses a bolt 5 which may be displaced within the socket in a direction perpendicular to the edge of the frame between two end positions shown in FIGS. 1 and 2. The bolt is secured to a connecting rod 6 extending outwardly of the socket, the outward end being encased by a solenoid 7. The rear end of the socket 3 is closed by a flange 8, also forming a bearing surface for a compression spring 9 disposed between the flange and the bolt 5, said compression spring being e.g. a helical spring surrounding the connecting rod 6. Moreover, the forward end of the bolt 5 has a freely rotatable pin 10 serving as an obstruction to sawing.

The solenoid 7 disposed within the frame or wall is connected to a primary power supply and to an auxiliary power supply as well as to a generator of opening and shutting impulses, such as a push button, code switch or a twilight switch.

The socket 4 of the door has a counterbolt 11 movable within the socket in a direction perpendicular to the edge of the door. A compression spring 12 is provided between the counterbolt 11 and the rear end of the socket 4, said compression spring being e.g. a helical spring and forcing the counterbolt toward the edge of the door. The spring force of spring 12 is smaller than that of spring 9. Each of the bolts has a rib, 13 and 14 respectively, coinciding with the grooves of the sockets 3 and 4. The groove corresponding to the rib of the bolt 5 extends to the socket 4 side of the door up to the point wherein the forward end of the bolt is located when the lock is in the shut position, and the groove corresponding to the rib 14 of the counterbolt extends in the socket of the door to the forward end thereof wherein a stop is provided. The ribs of the bolts and the grooves of the sockets thus serve as block stops for the movement of the bolts.

The counterbolt 11 is connected to a mechanical displacement means which may be operated from the inside of the door. A turning knob—not illustrated—serves as the displacement means, the axle of which carries a pinion 15 which may be brought into engagement with the toothed edge of the groove 16 of the counterbolt by pushing the turning knob inward. By turning the turning knob that is pushed inward, the counterbolt 11 may be moved towards the edge of the door from the position shown in FIG. 1 into the position shown in FIG. 2.

The edge of the door or frame has a switch, e.g. a stud switch sensing the open and shut position of the door and connecting, in the open position of the door, the power source to the solenoid 7.

The locking device of the invention operates as set forth hereinbelow. In the situation shown in FIG. 1, the door is locked, the bolt 5 being pushed into the socket 4 of the door. The door may be opened mechanically from the inside by pushing the pinion 15 into the groove 16 of the counterbolt and by turning the turning knob, the counterbolt 11 thereby moving to the left from the position shown in FIG. 1, pushing the bolt 5 in front thereof until the position shown in FIG. 2 has been reached, and then the door may be opened. As the door opens, the stud switch connects the power source to the solenoid that will draw the bolt 5 within the frame wherein it will remain as long as the door is open. The counterbolt is retained in the position shown in the Figure by the action of the spring 12.

When the door is shut, the motive force transmitted to the solenoid by the stud switch is disconnected. Then, on account of the more powerful spring 9 of the bolt 5, said bolt will be thrust into the socket of the door to the shut position thereof, pushing the counterbolt in front thereof until the situation shown in FIG. 1 is again reached.

The door is opened from the outside by connecting the power source to the solenoid for a prescribed period of time by using an exterior delayed impulse generator, such as a push button, a code switch, a twilight switch or the like. Within the prescribed time, the bolt 5 will be drawn out from its locked position from the socket of the door into the door frame, and the door may be opened. At this point, the stud switch will connect the current to the solenoid, and after the prescribed time period the current connected by the action of the impulse generator is cut off. The current connected to the solenoid via the stud switch will retain the bolt 5 in its inward position as long as the door is open. The door is shut as explained hereinabove.

The mechanical displacement means for the counterbolt 11 may be substituted with some other device achieving the corresponding operation, and the helical springs 9, 12 may be substituted with other spring means.

I claim:

1. A locking device for locking a door with regard to a door frame, each of which has a corresponding edge disposed in confronting adjacency one with the other when the door is shut, and disposed out of such confronting adjacency when the door is open, and each of which has a respective socket opening through the respective said edge thereof, the door having an inner side and an outer side, said locking device including:

a bolt mountable in said socket in said frame for longitudinal reciprocable movement, between a thrust, locking position wherein said bolt projects part way into said socket in said door so as to dispose a respective one end thereof in said socket of said door, and a retracted, unlocked position wherein said bolt, including said one end thereof, is completely withdrawn from said socket in said door;

a first spring operatively bearing against said bolt for tending to maintain said bolt in, and to return said bolt to, said thrust, locking position;

means operatively associated with said bolt selectively operable from said outer side of said door for forcibly reciprocating said bolt to said retracted, unlocked position and for maintaining said bolt, when retracted, in said retracted, unlocked position against restoration force exerted on said bolt by said first spring;

said selectively operable means from said outer side of said door for forcibly reciprocating said bolt to, and for maintaining said bolt in, said retracted, unlocked position comprises an electrical solenoid including said bolt, and switch means accessible from said outer side of said door when said door is shut for operating said electrical solenoid to forcibly reciprocate said bolt to, and maintain said bolt in said retracted, unlocked position;

a counterbolt mountable in said socket in said door for longitudinal reciprocable movement, between a thrust position wherein a respective one end thereof is closer to said edge of said door, and a retracted position wherein said one end of said counterbolt is disposed further back in said socket of said door relative to said edge of said door;

a second spring operatively bearing against said counterbolt for tending to maintain said counterbolt in, and to return said counterbolt to, said thrust position;

said second spring having a spring constant which is less than that of said first spring;

said bolt, first spring, counterbolt and second spring being so disposed that, in use, when the door exists in a shut condition with regard to the door frame, and said selectively operable means for reciprocating said bolt to, and for maintaining said bolt in, said retracted, unlocked position is not being operated, said bolt normally exists in said thrust, locking position with said one end of said bolt engaging said one end of said counterbolt and said first spring, acting via said bolt, thereby maintaining said counterbolt in said retracted position of said counterbolt; and a mechanical displacement-providing means engageable, in use, with said counterbolt, through the door, from the inner side of the door, and then being selectively operable for forcibly reciprocating said counterbolt towards said thrust position thereof sufficiently to forcibly retract said bolt towards said retracted position of said bolt sufficiently to expel said bolt from said socket of said door, so that said door may be opened and said bolt held retracted by said selectively operable means for reciprocating said bolt to, and for maintaining said bolt in, said retracted, unlocked position.

2. The locking device of claim 1, wherein:

said mechanical displacement providing means comprises:

a rack gear provided on said counterbolt, and a pinion operatively engageable with said rack gear and arranged to be manually rotated, in use, for thereby forcibly moving said counterbolt towards said thrust position thereof.

* * * * *